US006092976A

United States Patent [19]

Kamiya

[11] Patent Number: 6,092,976

[45] Date of Patent: Jul. 25, 2000

[54] DELAYED-ACTION EMPTY-SEAT SAFETY INTERLOCK FOR FORKLIFT CONTROLS

[75] Inventor: Toshikazu Kamiya, Kariya, Japan

[73] Assignee: Kabushiki Kaisha Toyoda Jidoshokki Seisakusho, Kariya, Japan

[21] Appl. No.: 09/206,133

[22] Filed: Dec. 7, 1998

[30] Foreign Application Priority Data

Dec. 11, 1997 [JP] Japan ..... 9-341286

[51] Int. Cl.[7] ..... B66F 9/24

[52] U.S. Cl. ..... 414/636; 414/620; 414/631; 187/223

[58] Field of Search ..... 414/619, 620, 414/631, 632, 633, 634, 635, 636, 639, 640, 641, 642; 187/222, 223

[56] References Cited

U.S. PATENT DOCUMENTS

| | | | |
|---|---|---|---|
| 3,827,532 | 8/1974 | Minich et al. | 187/222 X |
| 3,854,616 | 12/1974 | Willis et al. | 414/607 |
| 3,907,141 | 9/1975 | Ahrendt et al. | 187/223 X |
| 4,411,582 | 10/1983 | Nakada | 414/636 |
| 4,683,373 | 7/1987 | Tupman | 250/221 |
| 5,184,699 | 2/1993 | Aoki et al. | 414/631 X |
| 5,281,076 | 1/1994 | Lehman | 414/620 X |

FOREIGN PATENT DOCUMENTS

| | | | |
|---|---|---|---|
| 53-57624 | 5/1978 | Japan | 187/223 |
| 7-76498 | 3/1995 | Japan . | |
| 8-26695 | 1/1996 | Japan | 187/223 |
| 9-295800 | 11/1997 | Japan | 414/636 |

*Primary Examiner*—Robert P. Olszewski
*Assistant Examiner*—Gerald J. O'Connor
*Attorney, Agent, or Firm*—Morgan & Finnegan, L.L.P.

[57] ABSTRACT

A tilt control valve controls the flow of hydraulic oil to actuate the tilt cylinders of a forklift mast. The tilt control valve is switched between two positions by the forklift operator by means of a tilt lever. When at one position, the tilt control valve stops flow of oil to the tilt cylinders, thereby prohibiting tilting of the mast. When at the other position, the tilt control valve permits oil flow to the tilt cylinders, thereby allowing tilting of the mast. A control valve is located between the tilt cylinders and the tilt control valve. A seat switch detects whether or not the operator is sitting on the seat. A CPU permits the operator to continue to operate the tilt cylinders to tilt the mast when out of the seat for a brief period. However, after the brief period, the CPU closes the control valve to prevent movement of the mast unless the operator has returned to the seat. When the mast reaches a predetermined maximum acceptable tilt angle, the CPU also closes the control valve, thereby prohibiting motion of the tilt cylinders.

20 Claims, 5 Drawing Sheets

DELAYED-ACTION EMPTY-SEAT SAFETY INTERLOCK FOR FORKLIFT CONTROLS

BACKGROUND OF THE INVENTION

The present invention relates to a tilt cylinder controller in an industrial vehicle such as a forklift. More particularly, the present invention pertains to a controller that controls tilt cylinders, which tilt a mast that supports a load carrier such as a fork.

A typical industrial vehicle such as a forklift includes a mast pivotally supported on the front of the vehicle. The forklift also has a fork supported by the mast to be lifted and lowered. A lift lever is provided in the forklift's cab. An operator manipulates the lift lever to actuate lift cylinders thereby lifting and lowering the fork. A tilt lever is also provided in the cab. The operator manipulates the tilt lever to actuate tilt cylinders thereby tilting the mast forward or rearward.

When a load is on the fork, the center of gravity of the forklift is moved forward. Increasing the height of the fork increases the moment acting on the mast. Tilting the mast forward with a load on the fork further moves the center of gravity forward and thus destabilizes the forklift. Also, if a heavy load is on the fork and the mast is tilted rearward by a great angle, the forklift's center of gravity is moved rearward. This may cause a front wheel of the forklift to lose contact with the road surface and to spin. Therefore, the maximum forward tilt angle of the mast is typically set at six degrees, and the maximum rearward tilt angle is set at twelve degrees.

When removing a load from the fork to an elevated place, the mast is tilted forward with the fork raised. If the mast is tilted too quickly by an excessive angle, the load on the fork may shift and the rear wheels may lose contact with the road surface. Thus, the operator must carefully control the mast so that the mast is slowly tilted forward by a sufficiently small angle. This requires experience.

When loading and unloading the fork, the fork needs to be parallel with a pallet for carrying a load. In other words, the fork must be leveled. However, tilting of the mast supporting the fork is typically controlled by a manually controlled valve. That is, the operator manipulates the manual valve using the tilt lever thereby controlling flow of hydraulic oil from and into the tilt cylinders. Manipulating the tilt lever for accurately leveling the fork therefore requires experience. Further, the operator usually manipulates the tilt lever and the lift lever while driving the forklift. This makes operation of a forklift more difficult.

To facilitate operation, some forklifts are equipped with an electromagnetic valve, instead of a manual valve, for regulating oil flow from and into the tilt cylinders. The electromagnetic valve allows an operator with little experience to accurately control the tilting of mast. The electromagnetic valve also allows the operator to easily level the fork.

There are also forklifts that have an automatic stopping device for preventing the forklift from operating when the operator is not sitting on the seat in the cab. The stopping device detects whether the operator is sitting on the seat by using a sensor and prohibits the forklift's operation if the operator is not sitting on the seat.

However, if oil flow from and into tilt cylinders is controlled solely by an electromagnetic valve, the electromagnetic valve needs to be large and complex. This increases the manufacturing cost. Electromagnetic valves are spool type valves. A spool type valve includes a housing and a spool slidably housed in the housing. The spool has a circumferential surface slidably contacting the housing. A narrow clearance exists between the circumferential surface of the spool and the housing such that the spool moves smoothly in the housing. When a relatively great force acts on the valve, the clearance causes oil leakage. Compared to manual valves, the clearance in electromagnetic valves is large for allowing the spool to move smoothly. The larger clearance increases the amount of oil leakage.

If a forklift has an automatic stopping device and an electromagnetic valve for controlling the tilt cylinders, the tilt cylinders are immediately stopped when the operator leaves the seat. However, when tilting the mast with a bulky load on the fork, the operator may have to half-rise from the seat to look to the front. If the operator half-rises, the automatic stopping device immediately stops the tilt cylinders. The operator then has to sit on the seat again for resuming the operation. This results in inefficient operation of the forklift.

SUMMARY OF THE INVENTION

Accordingly, it is an objective of the present invention to provide a tilt cylinder controller for industrial vehicles that facilitates tilting control of a mast and does not hinder operation even if an operator stands up from the seat.

To achieve the above objective, the present invention provides a tilt cylinder controlling apparatus for an industrial vehicle. The industrial vehicle includes a mast tiltally supported on a body frame, a carrier supported by the mast for carrying a load, a tilt cylinder for tilting the mast and a cab for an operator. The apparatus includes a tilt valve, a handle, a fluid passage, a contorol valve, a first detctor, a second detector and a contoroller. The tilt valve that controls a supply of fluid to the tilt cylinder to actuate the tilt cylinder. The tilt valve is switched between a first position for preventing fluid from entering the tilt cylinder to prohibit tilting of the mast and a second position for permitting fluid to enter the tilt cylinder to cause tilting of the mast. The handle is used for manually controlling the tilt valve. The fluid passage is located between the tilt cylinder and the tilt valve. The control valve is located in the fluid passage. The control valve controls the flow of fluid in the fluid passage and thus selectively prohibits tilting motion of the mast. The first detector that detects whether an operator is at a predetermined operating position in the cab. The second detector that detects whether the tilt valve is moved to the second position by the handle. The controller for actuating the control valve and judges whether to close the control valve to prohibit movement of the tilt cylinder. The controller closes the control valve if the state of the first detector indicates that the operator has not occupied the predetermined operating position for a predetermined time period. The predetermined time period is selected so that the operator may briefly move from the predetermined operating position without affecting the control valve.

The present invention also provides a method for controlling tilting motion of a mast of a industrial vehicle. The method includes the step of judging whether an operator of the vehicle is in a predetermined operating position, measuring a time period from when the operator leaves the predetermined operating position, locking the mast against tilting motion if the operator remains away from the predetermined operating position for a predetermined time period, and selecting the predetermined time period so that the operator may briefly leave the predetermined position and return without locking the mast.

Other aspects and advantages of the invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings.

DETAILED DESCRIPTION OF THE PREFERRED EMBODIMENTS

Figure 1:
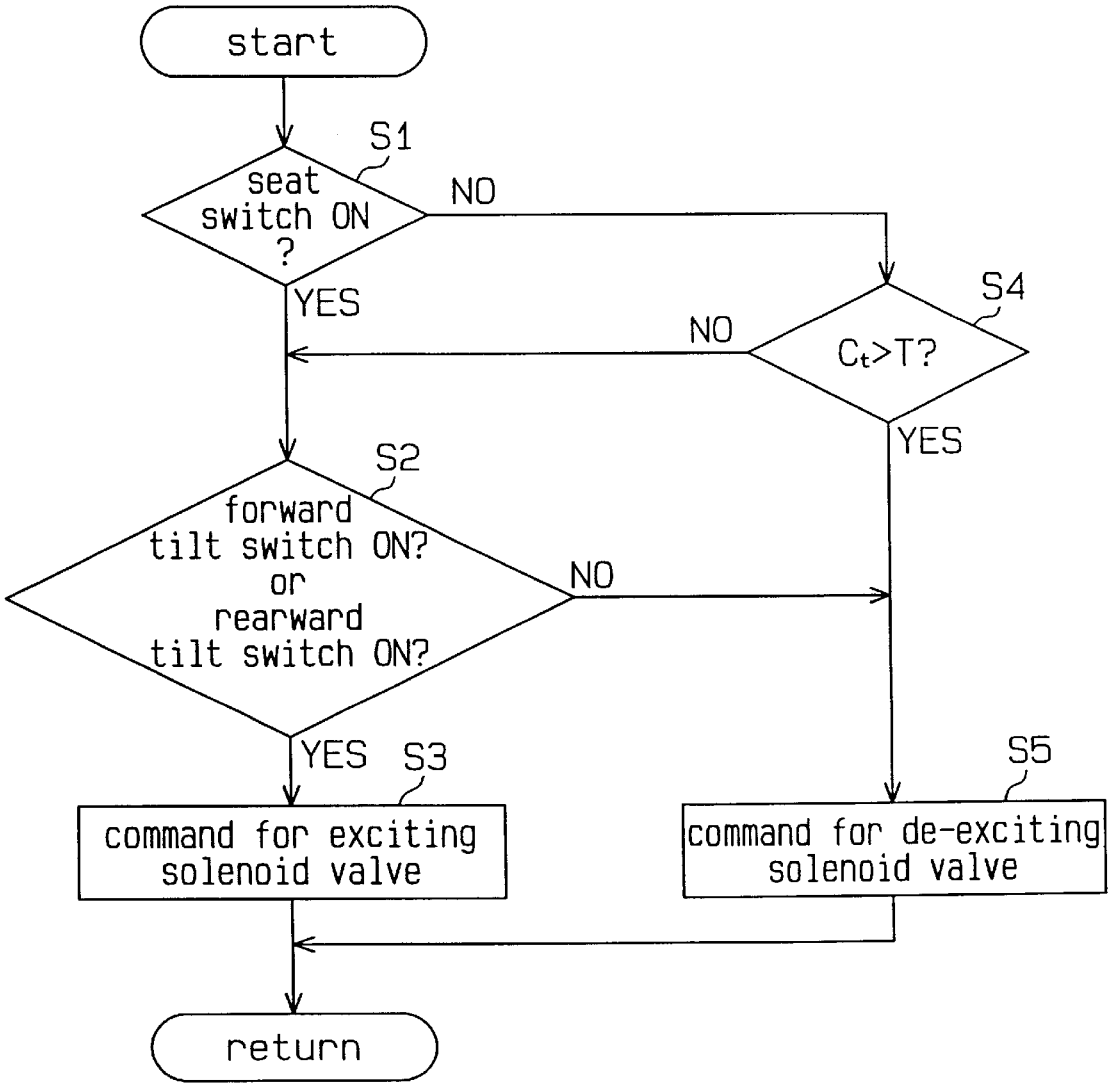
FIG. 1 is a flowchart showing a routine for controlling a solenoid valve according to a first embodiment of the present invention.

A forklift 1 according to a first embodiment of the present invention will now be described with reference to FIGS. 1–6. As shown in FIG. 3, a mast 3 is arranged on the front of the body frame 2 of the forklift 1. The mast 3 includes a pair of outer masts 3*a* pivotally supported by the body frame 2 and a pair of inner masts 3*b* arranged between the outer masts 3*a*. The inner masts 3*b* are lifted and lowered relative to the outer masts 3*a*. A lift cylinder 4 is secured to the back of each outer mast 3*a* to be parallel to the outer masts 3*a*. Each lift cylinder 4 includes a piston rod 4*a*. The distal end of each rod 4*a* is connected to the upper portion of the corresponding inner mast 3*b*. The forklift 1 further has a lift bracket 5, which is lifted and lowered along the inner masts 3*b*. Fork 6 for carrying load are attached to the bracket 5. A chain wheel 7 is supported on the top end of each inner mast 3*b*. A chain 8 is wound onto each chain wheel 7. Each chain 8 includes a first end connected to the top end of the corresponding lift cylinder 4 and a second end connected to the lift bracket 5. The lift cylinders 4 extend and retract the piston rods 4*a* thereby lifting and lowering the fork 6 together with the bracket 5 along the mast 3 by way of the chains 6.

The forklift 1 has tilt cylinders 9 each having a piston rod 9*a*. The proximal ends of the tilt cylinders 9 are pivotally supported by the side portions of the body frame 2. The distal end of each piston rod 9*a* is pivotally connected to the outer surface of the corresponding outer mast 3*a*. The cylinders 9 extend and retract the piston rods 9*a* thereby tilting the mast 3.

A seat 10 is located in a cab R. A seat switch 10*a* is located underneath the seat 10 for detecting whether an operator is sitting on the seat 10. The seat switch 10*a* is, for example, a limit switch. The seat switch 10*a* outputs an ON signal when an operator is sitting on the seat 10, and outputs an OFF signal when the operator is not sitting on the seat 10. In other words, the seat switch 10*a* detects whether the operator is at a predetermined position in the cab R.

A steering wheel 11, a lift lever 12 and a tilt lever 13 are arranged in the front of the cab R. In FIG. 3, the levers 12, 13 overlap one another. Manipulating the lift lever 12 actuates the lift cylinders 4, and manipulating the tilt lever 13 actuates the tilt cylinders 9.

Figure 2:
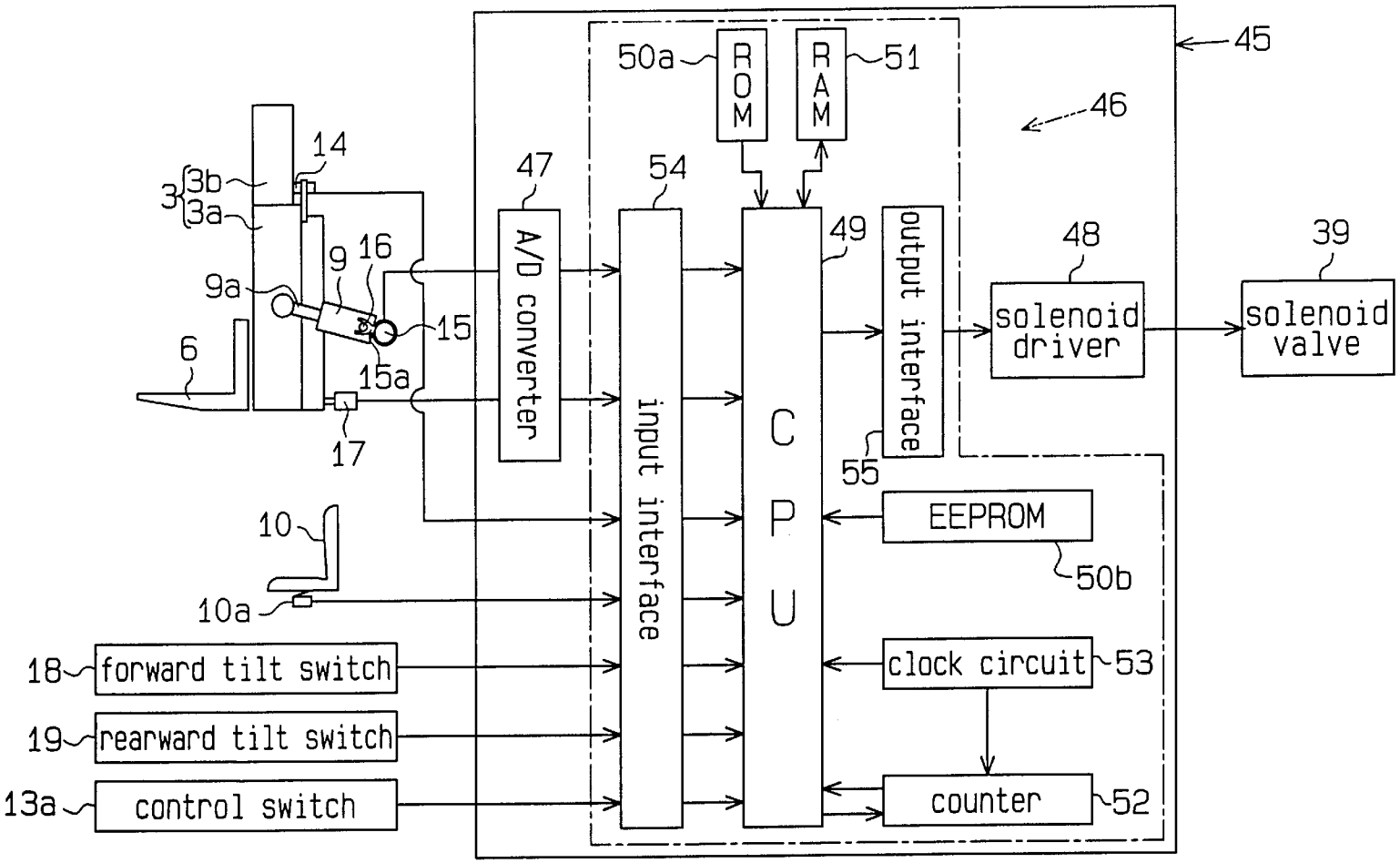
FIG. 2 is a block diagram showing the electric configuration of a controller according to the first embodiment.
Figure 3:
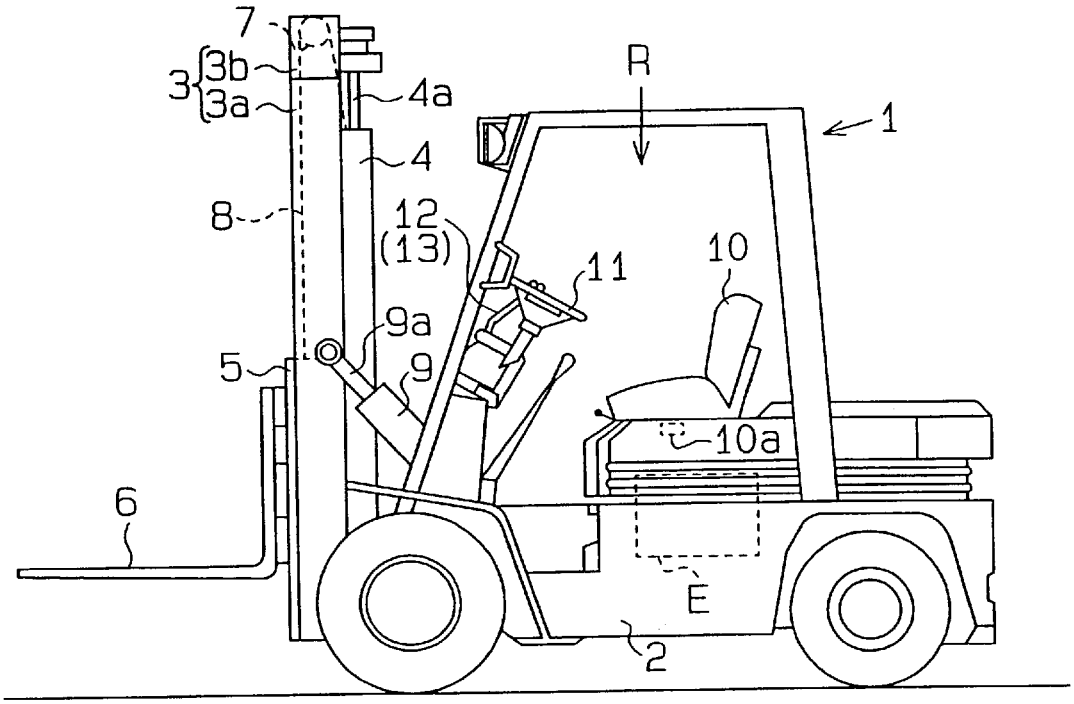
FIG. 3 is a side view showing a forklift having the controller of FIG. 2.

As shown in FIG. 2, a height sensor 14 is provided on one of the outer masts 3*a*. The height sensor 14 is a proximity switch that is turned on when detecting a detection part (not shown) fixed to the corresponding inner mast 3*b*. The height sensor 14 is turned on when the height H of the fork 6 is equal to or greater than a predetermined value $H_0$ and is turned off when the fork height H is smaller than the value $H_0$. The value $H_0$ is substantially one-half of the maximum height $H_{max}$ of the fork 6.

The body frame 2 has a rotational potentiometer 15 to detect the angle of the mast 3. The potentiometer 15 is located on a support that pivotally supports the tilt cylinder 9. The potentiometer 15 includes a rotational arm 15*a* for holding a pin 16 provided on the tilt cylinder 9. When the piston rod 9*a* is extended or retracted, the arm 15*a* pivots together with the tilt cylinder 9. The potentiometer 15 outputs a detection signal the voltage of which corresponds to the pivot amount of the arm 15*a*. The voltage of the signal from the potentiometer 15 is decreased as the mast 3 is tilted forward and is increased as the mast 3 is tilted rearward.

A pressure sensor 17 is located at the bottom of one of the lift cylinders 4. The pressure sensor 17 detects the pressure in the cylinder 4. The sensor 17 thus indirectly detects the weight on the fork 6 based on the pressure.

Figure 4:
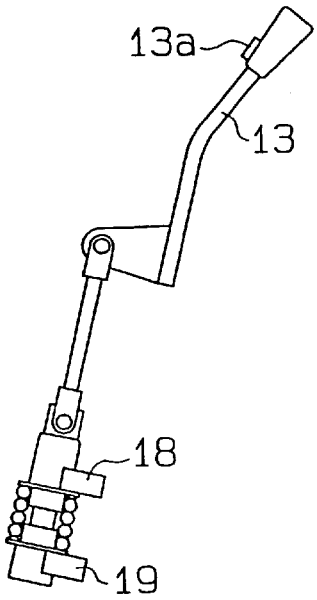
FIG. 4 is a side view showing the tilt lever of the forklift of FIG. 3.

As shown in FIG. 4, the tilt lever 13 has a forward tilt switch 18 and a rearward tilt switch 19. The forward tilt switch 18 detects forward tilting of the lever 13, whereas the rearward tilt switch 19 detects rearward tilting of the lever 13. The switches 18, 19 are microswitches. The forward tilt switch 18 is turned on when the tilt lever 13 is tilted forward relative to a neutral position and is turned off when the lever 13 is tilted rearward relative to the neutral position. The rearward tilt switch 19 is turned on when the tilt lever 13 is tilted rearward relative to the neutral position and is turned off when the lever 13 is tilted forward relative to the neutral position.

The tilt lever 13 also has a control switch 13*a*. The control switch 13*a* is used for automatically leveling the fork 6. The switch 13*a* outputs an ON signal when pressed and outputs an OFF signal when released.

Figure 5:
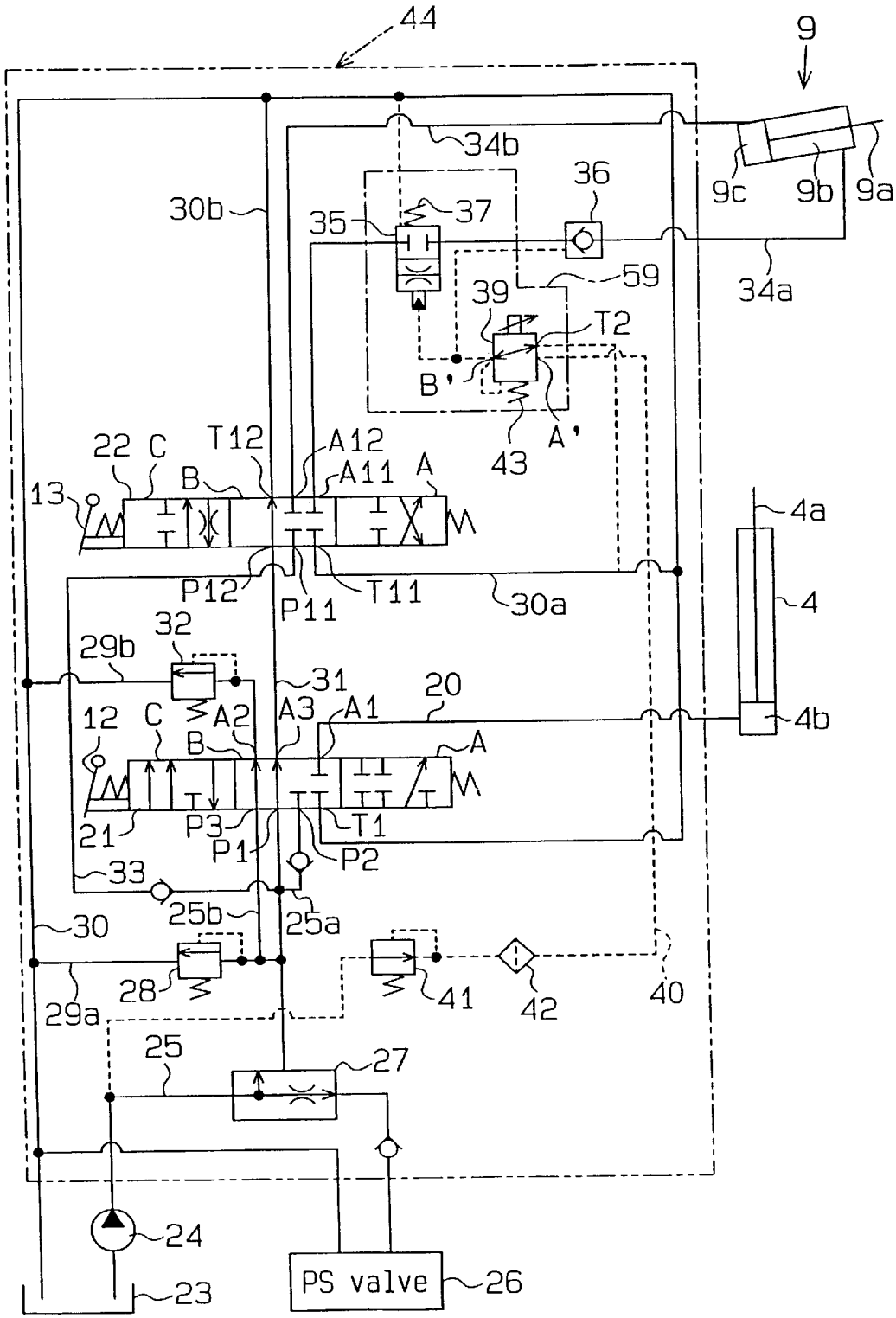
FIG. 5 is a diagram showing a hydraulic circuit of the tilt cylinders and the lift cylinders in the forklift of FIG. 3.

FIG. 5 illustrates a hydraulic circuit 44 for actuating the lift cylinders 4 and the tilt cylinders 9. The lift cylinders 4 and the tilt cylinders 9 are each represented by a single cylinder in FIG. 5. The lift cylinders 4 have a bottom chamber 4*b* connected to a lift control valve 21 by way of a passage 20. The lift control valve 21 is a manually controlled three-way switch valve that has seven ports. The valve 21 includes a valve housing and a spool reciprocally accommodated in the housing. The spool is moved by the lift lever 12. When the lift lever 12 is at a position to lift the fork 6, the spool is at a first position A. When the lever 12 is at a neutral position, the spool is at a second position B to fix the vertical position of the fork 6. When the lever 12 is at a position to lower the fork 6, the spool is at a third position C.

The tilt cylinders 9 are controlled by a tilt control valve 22. The tilt control valve 21 is a three-way switch valve that has six ports. The valve 22 includes a valve housing and a spool reciprocally accommodated in the housing. The spool is moved by the tilt lever 13. When the lift lever 13 is at a position to tilt the mast 3 rearward, the spool is at a first position A. When the lever 13 is at a neutral position, the spool is at a second position B to fix the tilting of the mast 3. When the lever 13 is at a position to tilt the mast 3 forward, the spool is at a third position C.

Hydraulic oil is supplied to the cylinders 4, 9 from an oil tank 23 by a pump 24. The pump 24 is driven by an engine E (see FIG. 3). The pump 24 is connected to a port P1 of the lift control valve 21 by way of a supply passage 25. The supply passage 25 includes a flow divider 27. The flow divider 27 divides oil from the pump 24 to the cylinders 4, 9 and to a power steering valve (PS valve) 26. The passage 25 is connected to ports P2 and P3 of the lift control valve 21 by branch passages 25*a*, 25*b*, respectively. The supply passage 25 is connected to a return passage 30 by a passage 29*a* having a relief valve 28. A port T1 of the lift control valve 21 is connected to the return passage 30. A port A1 of the valve 21 is connected to a passage 20. A port A2 of the valve 21 is connected to a passage 29*b* having a relief valve 32. A port A3 of the valve 21 is connected to a passage 31. The passage 29*b* is connected to the return passage 30. Pressure required to open the relief valve 32 is smaller than pressure required to open the relief valve 28.

The pump 24 is also connected to a port P11 of the tilt control valve 22 by way of a passage 33 branching off from the supply passage 25. A port P12 of the valve 22 is connected to the passage 31. A port T11 of the valve 22 is connected to a return passage 30*a*. A port T12 of the valve 22 is connected to a return passage 30*b*. A port A11 of the valve 22 is connected to a passage 34*a*. A port A12 of the valve 22 is connected to a passage 34*a*. The passage 34*a* is connected to a rod chamber 9*b* defined in the tilt cylinder 9. The passage 34*a* is connected to a bottom chamber 9*c* defined in the tilt cylinder 9.

The passage 34*a* has a control valve 59. The control valve 59 is, for example, an electromagnetic flow control valve, which changes the size of its opening in accordance with a supplied electric current. The valve 59 includes a main valve 35 for controlling the amount of oil flowing in the passage 34*a* and a solenoid valve 39 for applying a pilot pressure to the main valve 35. Oil from the pump 24 is directly supplied to the solenoid valve 39 through a pilot line 40. The pilot line 40 is branched off from the supply passage 25 and includes a pressure reducing valve 41 and a filter 42. The solenoid valve 39 generates electromagnetic force in accordance with current value supplied thereto. The solenoid valve 39 uses oil supplied through the pilot line 40 and applies pilot pressure to the main valve 35 in accordance with the generated electromagnetic force.

The solenoid valve 39 is a normally closed valve and has ports A', B' and a tank port T2. The tank port T2 is connected to a return passage 30*a*. The port A' is connected to the pilot line 40. The port B' is connected to the main valve 35.

The solenoid valve 39 has a valve housing, a spool reciprocally housed in the housing and a spring 43. When the valve 39 is de-excited, the spool is urged by the spring 43 and is located at a position to connect the port B' with the tank port T2. When the valve 39 is excited, the spool is moved to a position to connect the port A' with the port B'. The position of the spool is determined by the equilibrium of the urging force of the spring 43 and the force of the solenoid, which depends on current value supplied to the valve 39. That is, the position of the spool is changed in accordance with the current value. Pilot pressure, which is determined by the position of the spool, is supplied to the main valve 35.

The main valve 35 includes a valve housing, a spool reciprocally housed in the housing and a spring 37. The spool is urged in one direction by the spring 37. The pilot pressure urges the spool in a direction opposite to that of the urging force of the spring 37. The position of the spool is therefore determined by the equilibrium of the force of the spring 37 and that produced by the pilot pressure. Thus, the position of the spool is changed by the pilot pressure, and the opening of the main valve 35 changes accordingly. In other words, the amount of oil flow in the main valve 35 is determined by the current value supplied to the solenoid valve 39. When no current is supplied to the solenoid valve 39, the pilot pressure is not applied to the main valve 35. This causes the main valve 35 to close the passage 34*a*.

A check valve 36 is located in the passage 34*a* between the main valve and the rod chamber 9*b*. The check valve 36 includes a valve seat and a valve body facing the valve seat. The valve body contacts and separates from the valve seat. The solenoid valve 39 applies the pilot pressure to the check valve 36 as well as to the main valve 35. When receiving the pilot pressure, the check valve 36 is opened and allows oil flow from the main valve 35 to the tilt cylinder 9 and in the reverse direction. When receiving no pilot pressure, the check valve 36 prohibits oil flow from the tilt cylinder 9 to the main valve 35.

The lift control valve 21, the tilt control valve 22, the check valve 36, the relief valves 28, 32, the main valve 35, the solenoid valve 39 and the pressure reducing valve 41 constitute a valve system 44 accommodated in a single housing.

The electric configuration of the hydraulic circuit will now be described.

As shown in FIG. 2, a controller 45 includes a microcomputer 46, an analog-to-digital (A/D) converter 47 and a solenoid driver 48. The microcomputer 46 has a central processing unit 49, an electrically erasable programmable read-only memory (EEPROM) 50*b*, a random access memory (RAM) 51, a counter 52, a clock circuit 53, an input interface 54 and an output interface 55. The counter 52 counts clock signals from the clock circuit 53 and functions as a timer. The counter 52 is reset by a reset signal from the CPU 49.

Figure 6:
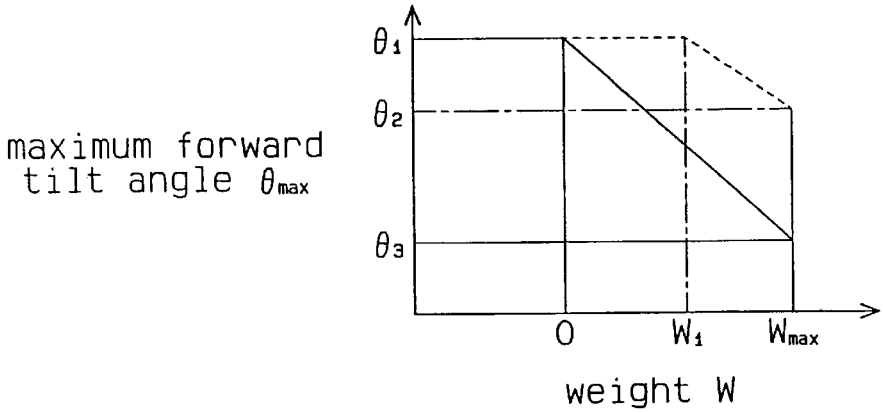
FIG. 6 is a map showing the relationship between the weight of a load and the maximum acceptable value of forward tilting of the mast in the forklift of FIG. 2.

The ROM 50*a* stores programs and data required for executing the programs. The EEPROM 50*b* stores a map or equations defining the relationship between the weight W on the fork 6 and the maximum forward tilt angle $\theta_{max}$ of the mast 3. FIG. 6 shows an example of such a map. The diagonal solid line in the map shows data used when the fork height H is equal to or greater than a threshold value $H_0$, and the uniformly broken line shows data used when the fork height H is lower than the threshold value $H_0$. When the fork height H is equal to or greater than the threshold value $H_0$, the maximum forward tilt angle $\theta_{max}$ decreases from an angle $\theta_1$ (for example, six degrees) to an angle $\theta_3$ (for Example, two degrees) as the weight W on the fork 6 increases from zero to a predetermined maximum acceptable value $W_{max}$. When the fork height H is lower than the threshold value $H_0$, the maximum forward tilt angle $\theta_{max}$ is maintained at the angle $\theta_1$ if the weight W on the fork 6 is between zero and a threshold value $W_1$. However, as the weight W increases from the value $W_1$ to the maximum acceptable value $W_{max}$, the maximum forward tilt angle $\theta_{max}$ decreases from the angle $\theta_1$ to an angle $\theta_2$ ($\theta_2>\theta_3$) The position of the height sensor 14, or the threshold value H0 of the fork height H, may be changed, and the map of FIG. 6 can be changed accordingly.

The CPU 49 is connected to the potentiometer 15 and the pressure sensor 17 by the A/D converter and the input interface 54. The CPU 49 is also connected to the seat switch 10*a*, the control switch 13*a*, the height sensor 14, the forward tilt switch 18 and the rearward tilt switch 19 by the input interface 54. The CPU 49 is connected to the solenoid driver 48 by the output interface 55.

The CPU 49 receives signals from the sensors 14, 15, 17 and the switches 10*a*, 13*a*, 18, 19. When actuating the tilt cylinder 9, the CPU 49 sends control signals to the solenoid valve 39 by way of the solenoid driver 48 according to the programs stored in the ROM 50*a*.

When receiving an ON signals from the seat switch 10*a* and from the forward tilt switch 18 or the rearward tilt switch 19, the CPU 49 outputs an exciting signal to the solenoid valve 39. When the signal from the seat switch 10*a* is changed from the ON signal to an OFF signal, the CPU 49 continues to send the exciting signal to the solenoid valve 39 for a predetermined period as long as an ON signal is received from either the switches 18 or 19. The predetermined period is sufficiently long (for example, one to seven seconds) such that the tilting of the mast 3 is not interrupted when an operator temporarily stands up from the seat 10 while looking to the front and manipulating the tilt lever 13. In this embodiment the period is set at five seconds.

The operation of the above apparatus will now be described.

The hydraulic pump 24 is actuated when the engine E is started. The pump 24 then supplies oil in the oil tank 23 to the supply passage 25. Therefore, when actuated, the pump 24 immediately applies oil pressure to the pilot line 40.

When the lift lever 12 is moved from the neutral position to the lifting position, the spool of the lift control valve 21 is moved to the position A and connects the branch passage 25*a* with the passage 20. The spool sends oil from the pump 24 to the bottom chamber 4*a* of the lift cylinder 4 thereby extending the lift cylinder 4. The lift cylinder 4 lifts the fork 6, accordingly. When the lift lever 12 is moved to the lowering position, the spool of the valve 21 is moved to the position C. The spool connects the passage 20 with the return passage 30, the supply passage 25 with the passage 31, and the branch passage 25*b* with the passage 29*b*. Accordingly, the oil in the bottom chamber 4*a* is returned to the oil tank 23. The lift cylinder 4 is retracted thereby lowering the fork 6.

When the tilt lever 13 is at the neutral position, the spool of the tilt control valve 22 is at the position B as shown in FIG. 5. The spool disconnects the passages 34*a*, 34*b*, which are connected to the tilt cylinder 9, from the supply passage 33 and the return passage 30*a*. Accordingly, oil flow into and out of the tilt cylinder 9 is prohibited. In other words, the tilt cylinder 9 is locked and the mast 3 is fixed at a desired tilt angle.

When the tilt lever 13 is tilted forward, the spool of the tilt control valve 22 is moved to the position C. The spool then communicates the supply passage 33 with the passage 34*b* and the passage 34*a* with the return passage 30*a*. This extends the tilt cylinder 9. The spool of the tilt control valve 22 is moved to the position A when the tilt lever 13 is tilted rearward. The spool communicates the supply passage 33 with the passage 34*a* and the return passage 30*a* with the passage 34*b*. This retracts the tilt cylinder 9.

The CPU 49 executes a program illustrated by a flowchart of FIG. 1 and sends a signal for actuating the solenoid valve 39 to the solenoid driver 48. At step S1, the CPU 49 judges whether the seat switch 10*a* outputs an ON signal. If the determination is positive, the CPU 49 moves to step S2. At step S2, the CPU 49 judges whether the forward tilt switch 18 or the rearward tilt switch 19 outputs an ON signal. If one of the switches 18, 19 outputs an ON signal, the CPU 49 moves to step S3. At step S3, the CPU 49 sends an exciting command signal to the solenoid driver 48.

If the seat switch 10*a* is off at step S1, the CPU 49 moves to step S4. At step S4, the CPU 49 judges whether a predetermined time period has elapsed since the seat switch 10*a* was turned off. Particularly, the CPU 49 compares the time period $C_t$, which has elapsed from turning off of the seat switch 10*a*, to a predetermined time period T (five seconds in this embodiment). The CPU 49 measures time using the counter 52. If the time $C_t$, during which is the seat switch 10*a* is off, exceeds the predetermined time T, the CPU 49 moves to step S5. At S5, the CPU 49 sends a de-exciting command signal to the solenoid driver 48.

If the time $C_t$ has not exceeded the time T, the CPU 49 moves to step S2. At step S2, the CPU 49 judges whether either one of the switches 18, 19 is producing an ON signal. Depending on the determination of S2, the CPU 49 moves either to step S3 or step S5.

That is, the CPU 49 excites the solenoid driver 48 when one of the switches 18, 19 and the seat switch 10*a* output ON signals. Also, before the predetermined period T elapses, the CPU 49 excites the solenoid driver 48 upon receiving an ON signal from either switch 18 or 19. The period T is measured from the time the seat switch 10*a* is turned off, or from when the operator rises.

When receiving an exciting signal, the solenoid valve 39 opens thereby applying the pilot pressure to the main valve 35 and the check valve 36. This permits oil to flow in the passage 34*a*. As a result, oil flows into the tilt cylinder 9 and the cylinder 9 tilts the mast 3 forward or rearward.

When the seat switch 10*a* is on or when the predetermined period T has not elapsed since the seat switch 10*a* was turned off, the CPU 49 executes a process for prohibiting tilting of the mast 3 upon receiving an ON signal from the forward tilt switch 18. In this process, the CPU 49 calculates the weight W on the fork 6 based on a signal from the pressure sensor 17. The CPU 49 also judges whether the fork height H detected by the height sensor 14 is equal to or greater than the threshold value $H_0$. The CPU 49 then computes the maximum acceptable tilt angle $\theta_{max}$ based on the detected fork height H and the weight W using the map of FIG. 6 or equations. The CPU 49 calculates the tilt angle of the mast 3 based on a signal from the potentiometer 15 and compares the calculated angle with the maximum angle $\theta_{max}$.

When the mast angle reaches the maximum angle $\theta_{max}$, the CPU 49 stops sending an exciting signal to the solenoid valve 39 even if the forward tilt switch 18 is outputting an ON signal. As a result, the solenoid valve 39 stops applying the pilot pressure to the main valve 35 and the check valve 36 thereby prohibiting oil flow from the rod chamber 9*b* to the tilt control valve 22. In other words, even if the operator manipulates the tilt lever 13 to tilt the mast 3 forward, the forward tilting of the mast 3 is stopped at the maximum acceptable forward tilt angle $\theta_{max}$, which is determined in accordance with the weight W on the fork 6.

If the tilt lever 13 is moved to the neutral position before the mast 3 reaches the maximum forward tilt angle $\theta_{max}$, the CPU 49 de-excites the solenoid 39. That is, the mast 3 is stopped at the angle position chosen by the operator when its tilt angle is smaller than the maximum forward tilt angle $\theta_{max}$.

The automatic leveling procedure will now be described. When the fork 6 is tilted rearward, if the operator tilts the tilt lever 13 forward while pressing the control switch 13*a*, the CPU 49 receives ON signals from the control switch 13*a* and the forward tilt switch 18. The CPU 49 excites the solenoid valve 39, and the check valve 36 permits oil flow from the rod chamber 9*b* to the tilt control valve 22. When receiving an ON signal from the control switch 13*a*, the CPU 49 judges whether the mast angle reaches zero degrees, or whether the fork 6 is leveled, based on signals from the potentiometer 15.

When the fork 6 is leveled, the CPU 49 outputs a de-exciting signal to the solenoid driver 48. As a result, the solenoid valve 39 is closed and stops applying the pilot pressure to the main valve 35 and the check valve 36. Accordingly, oil flow from the rod chamber 9*b* to the tilt control valve 22 is prohibited. Therefore, the tilting of the mast 3 is automatically stopped when the fork 6 is leveled, and the operator does not need to stop tilting the tilt lever 13.

When the fork 6 is tilted forward, if the operator tilts the tilt lever 13 rearward while pressing the control switch 13*a*, the CPU 49 receives ON signals from the control switch 13*a* and the rearward tilt switch 19. As in the case where the tilt lever 13 is tilted forward, the automatic leveling procedure is executed. That is, when the tilt angle of the mast 3 reaches zero degrees, or when the fork 6 is leveled, the CPU 49 outputs a de-exciting signal to the solenoid driver 48. As a result, the solenoid valve 39 closes the passage 34*a* thereby stopping the rearward tilting of the mast 3. Therefore, the tilting of the mast 3 is automatically stopped when the fork 6 is leveled, and the operator does not need to stop tilting the tilt lever 13.

The embodiment of FIGS. 1 to 6 has the following advantages.

(1) Oil flow from and into the tilt cylinder 9 is controlled by a manually controlled switch valve (the tilt control valve 22) and the control valve 59, which is controlled by the CPU 49. These two valves 22, 59 allow an operator to manually control the tilt angle of the mast 3 and the fork 6 to be the automatically leveled. The valves 22, 59 also automatically change the maximum tilt angle of the mast 3. This construction facilitates leveling of the fork 6 and forward tilting of the mast 3 when the fork 6 is high.

(2) When an operator leaves the seat 10 and the seat switch 10*a* is turned off, the CPU 49 continues the same procedure performed when the seat switch 10*a* is on for a predetermined period. This allows an operator to operate the forklift while temporarily half-rising from the seat 10, which improves the operation efficiency.

(3) The amount of oil flow through the main valve 35 is easily controlled by changing current value supplied to the solenoid valve 39. Therefore, when prohibiting tilting of the mast 3 and when leveling the fork 6, the amount of oil flow through the valve 35 may be increased until the angle of the mast 3 becomes close to a target angle. Then, when the mast angle is approaching to the target angle, the flow amount through the valve 35 may be decreased for decelerating the tilting speed of the mast 3. This reduces the shock caused by stopping the tilting of the mast 3 thereby accurately stopping the mast 3 at the desired angle. Further, controlling the flow amount through the valve 35 shortens the time required to tilt the mast 3 to the desired angle. Also, the tilting speed of the mast 3 is easily controlled.

(4) If a relatively high pressure is applied to the tilt control valve 22 and the main valve 35, oil leaks through the clearances between the spools of the valves 22, 35 and their housings. However, when the tilting of the mast 3 is stopped, the check valve 36 located in the passage 34*a* between the tilt control valve 22 and the rod chamber 9*b* is closed. This prevents the high pressure from acting on the tilt control valve 22 and on the main valve 35. Therefore, when holding the mast 3 at a certain tilt angle for a prolonged period, the angle of the mast 3 is securely maintained.

(5) The potentiometer 15 outputs voltage corresponding to the tilt angle of the mast 3. Changes in the tilt angle are therefore easily detected.

(6) The height H of the fork 6 is simply divided into two height ranges, that is, into a range below the threshold value Ho and a range equal to and higher than the value $H_0$. The maximum forward tilt angle $\theta_{max}$ of the mast 3 is determined based on the range the fork 6 is in. This facilitates the calculation executed by the CPU 49.

It should be apparent to those skilled in the art that the present invention may be embodied in many other specific forms without departing from the spirit or scope of the invention. Particularly, it should be understood that the invention may be embodied in the following forms.

The seat switch 10*a* may be a proximity switch or a light switch. Instead of detecting the position of an operator by the seat switch 10*a*, the position of an operators feet may be detected to judge whether the operator is at a certain position in the cab R. The seat 10 therefore may be omitted. In this case, the operator stands when operating the forklift 1.

Figure 7:
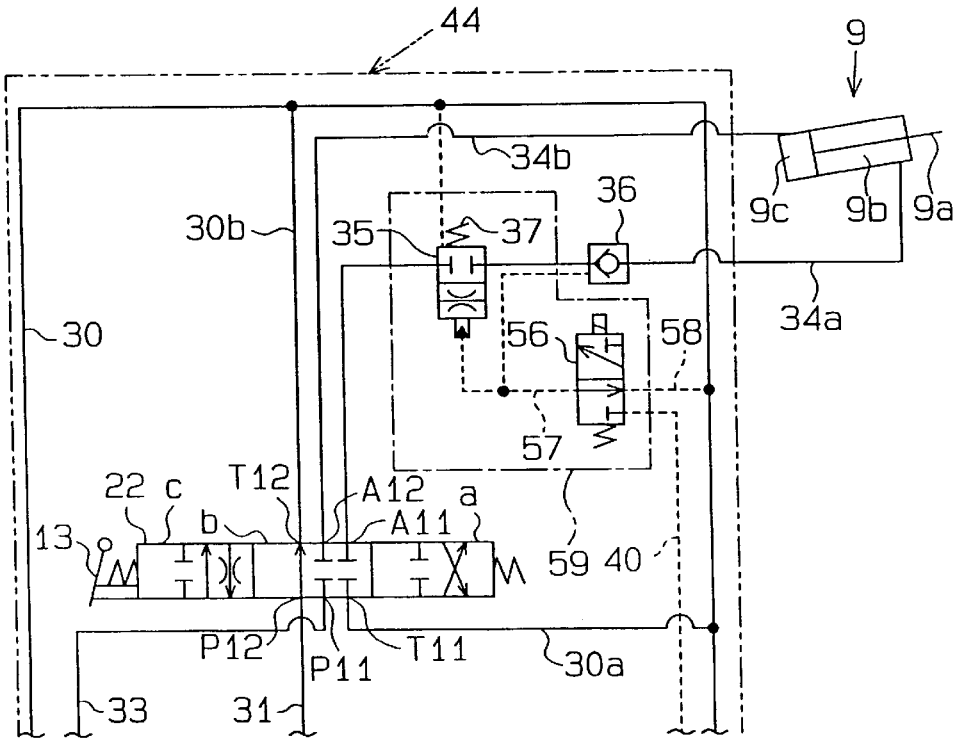
FIG. 7 is a diagram showing a hydraulic circuit according to a second embodiment.

The solenoid valve 39 changes the pilot pressure applied to the main valve 35 and to the check valve 36 in accordance with the supplied current. The solenoid valve 39 may be replaced with an on-off solenoid valve 56 shown in FIG. 7. The on-off solenoid valve 56 selectively connects the pilot passage 40 with the main valve 35 and the check valve 36. When supplied with current, the valve 56 connects a passage 57 with the pilot line 40 thereby applying the pilot pressure to the main valve 35 and the check valve 36. When receiving no current, the valve 56 connects 57 with the return passage 30 through a passage 58. The device of FIG. 7 performs the maximum tilt angle control and the automatic fork leveling control like the device of FIGS. 1 to 6. Further, the device of FIG. 7 has a simpler construction than that of FIGS. 1 to 6.

In the illustrated embodiments, the mast angle is detected by the potentiometer 15, which detects the rotation amount of the tilt cylinder 9. However, the mast angle may be detected by other types of sensors. For example, a linear potentiometer may be used for detecting length of the tilt cylinder 9, or the extension amount of the piston rod 9*a*. The lower end of the mast 3 is supported by supporting axles, which pivot as the mast 3 tilts. The rotation amount of the supporting axles may be detected by a potentiometer or a rotary encoder for measuring the tilt angle of the mast 3.

The check valve 36 may be omitted. In this case, the main valve 35 may be located in the passage 34, which connects the bottom chamber 9*c* with the tilt control valve 22.

The main valve 35, which is actuated by the pilot pressure, may be replaced with an electromagnetic valve that selectively opens the passage 34*a* based on whether current is supplied thereto. This simplifies the construction of the apparatus.

Instead of the proximity switch, a limit switch or a light switch may be used as the height sensor 14.

The number of the height sensor 14 may be more than one. In this case, the height H of the fork 6 is divided in three or more height ranges. Alternatively, a sensor that continuously detects the fork height H may be employed. This allows the fork height H to be divided into additional ranges, and, alternatively, it permits the fork height to be used in a continuous function.

In the illustrated embodiments, the pilot line 40 is connected with and receives the pilot pressure from the pump 24. Instead, the pilot line 40 may be connected with an engine driven pump having a smaller displacement than the pump 24. In this case, the pressure reducing valve 41 may be omitted.

In the illustrated embodiments, the control valves 21, 22, 59 are accommodated in the single housing 44. However, the valves 21, 22, 59 may be independent from one another.

The present invention may be applied to industrial vehicles other than the forklift 1. For example, the present invention may be applied to vehicles having loading attachment other than a fork, for example, a roll clamp for carrying rolled paper, a block clamp for carrying and stacking blocks, or a ram for carrying coiled objects such as coiled wire and cable.

Further, the present invention may be applied to industrial vehicle having a battery-driven motor as its drive source instead of an engine.

Therefore, the present examples and embodiments are to be considered as illustrative and not restrictive and the invention is not to be limited to the details given herein, but may be modified within the scope and equivalence of the appended claims.

What is claimed is:

1. A tilt cylinder controlling apparatus for an industrial vehicle, wherein the industrial vehicle includes a mast tiltally supported on a body frame, a carrier supported by the mast for carrying a load, a tilt cylinder for tilting the mast and a cab for an operator, the apparatus comprising:

a tilt valve that controls a supply of fluid to the tilt cylinder to actuate the tilt cylinder, wherein the tilt valve is switched between a first position for preventing fluid from entering the tilt cylinder to prohibit tilting of the mast and a second position for permitting fluid to enter the tilt cylinder to cause tilting of the mast;

a handle for manually controlling the tilt valve;

a fluid passage located between the tilt cylinder and the tilt valve;

a control valve located in the fluid passage, wherein the control valve controls the flow of fluid in the fluid passage and thus selectively prohibits tilting motion of the mast;

a first detector that detects whether an operator is at a predetermined operating position in the cab;

a second detector that detects whether the tilt valve is moved to the second position by the handle; and a controller for actuating the control valve, wherein the controller judges whether to close the control valve to prohibit movement of the tilt cylinder, and the controller closes the control valve if the state of the first detector indicates that the operator has not occupied the predetermined operating position for a predetermined time period, wherein the predetermined time period is selected so that the operator may briefly move from the predetermined operating position without affecting the control valve.

2. The apparatus according to claim 1, wherein a seat is located in the cab, and wherein the first detector detects whether the operator is sitting on the seat.

3. The apparatus according to claim 1, wherein the controller closes the control valve if the tilt angle of the mast reaches a predetermined maximum acceptable tilt angle.

4. The apparatus according to claim 3, wherein the carrier is lifted and lowered along the mast, and wherein the controller changes the maximum acceptable tilt angle in accordance with the height of the carrier and the weight on the carrier.

5. The apparatus according to claim 1, further comprising a switch that is manipulated for automatically leveling the carrier, wherein when the detector is manipulated and the tilt valve is at the second position, the controller closes the control valve if the carrier is level.

6. The apparatus according to claim 1, further comprising a check valve located in the fluid passage between the tilt cylinder and the control valve, wherein when the control valve is closed, the check valve prohibits fluid flow from the tilt cylinder to the control valve, and when the control valve is open, the check valve is held open.

7. The apparatus according to claim 1, wherein the control valve comprises a main valve located in the fluid passage and a solenoid valve for applying a pilot pressure to the main valve, wherein the controller controls the solenoid valve such that the pilot pressure is applied to the main valve to open the main valve, and wherein a lack of pilot pressure closes the main valve.

8. The apparatus according to claim 7, wherein the controller controls the solenoid valve to change the magnitude of the pilot pressure applied to the main valve thereby controlling the opening of the main valve.

9. The apparatus according to claim 7, further comprising a check valve located in the fluid passage between the tilt cylinder and the main valve, wherein the check valve is opened by the force of the pilot pressure, and when there is a lack of pilot pressure, the check valve prohibits fluid flow from the tilt cylinder to the main valve.

10. A tilt cylinder controlling apparatus for a forklift, wherein the forklift includes a mast tiltally supported on a body frame, a fork supported by the mast for carrying a load, a tilt cylinder for tilting the mast and a seat for an operator, the apparatus comprising:

a tilt valve that controls a supply of fluid to the tilt cylinder to actuate the tilt cylinder, wherein the tilt valve is switched among a first position for preventing fluid from entering the tilt cylinder to prohibit tilting of the mast, a second position for permitting fluid to enter the tilt cylinder to cause forward tilting of the mast and a third position for permitting fluid to enter the tilt cylinder to cause rearward tilting of the mast;

a handle for manually controlling the tilt valve;

a fluid passage located between the tilt cylinder and the tilt valve;

a control valve located in the fluid passage, wherein the control valve controls the flow of fluid in the fluid passage and thus selectively prohibits tilting motion of the mast;

a first detector that detects whether an operator is sitting on the seat;

a second detector that detects whether the tilt valve is moved to the second position by the handle;

a third detector that detects whether the tilt valve is moved to the third position by the handle;

a tilt angle sensor that responds to tilting movement of the mast; and a controller for actuating the control valve, wherein the controller judges whether to close the control valve to prohibit movement of the tilt cylinder, and the controller closes the control valve if the state of the first detector indicates that the operator has not sat on the seat for a predetermined time period, wherein the predetermined time period is selected so that the operator may briefly rise from the seat without affecting the control valve, and the controller permits the tilt cylinder to be moved by the operator during the predetermined time period as long as the tilt angle of the mast is within a permissible range of angles based on the state of the tilt angle sensor.

11. The apparatus according to claim 10, wherein the fork is lifted and lowered along the mast, and wherein the controller changes the maximum acceptable tilt angle in accordance with the height of the fork and the weight on the fork.

12. The apparatus according to claim 10, further comprising a switch that is manipulated for automatically leveling the fork, wherein when the switch is manipulated and the tilt valve is at the second or third position, the controller closes the control valve if the fork is level.

13. The apparatus according to claim 10, further comprising a check valve located in the fluid passage between the tilt cylinder and the control valve, wherein when the control valve is closed, the check valve prohibits fluid flow from the tilt cylinder to the control valve, and when the control valve is open, the check valve is held open.

14. The apparatus according to claim 10, wherein the control valve comprises a main valve located in the fluid passage and a solenoid valve for applying a pilot pressure to the main valve, wherein the controller controls the solenoid valve such that the pilot pressure is applied to the main valve to open the main valve, and wherein a lack of pilot pressure closes the main valve.

15. The apparatus according to claim 14, wherein the controller controls the solenoid valve to change the magnitude of the pilot pressure applied to the main valve thereby controlling the opening of the main valve.

16. The apparatus according to claim 14, further comprising a check valve located in the fluid passage between the tilt cylinder and the main valve, wherein the check valve is opened by the force of the pilot pressure, and when there is a lack of pilot pressure, the check valve prohibits fluid flow from the tilt cylinder to the main valve.

17. A method for controlling tilting motion of a mast of an industrial vehicle comprising:

judging whether an operator of the vehicle is in a predetermined operating position;

measuring a time period from when the operator leaves the predetermined operating position;

locking the mast against tilting motion if the operator remains away from the predetermined operating position for a predetermined time period; and selecting the predetermined time period so that the operator may briefly leave the predetermined position and return without locking the mast.

18. The method of claim 17 including:

locking the mast if the mast is tilted beyond a predetermined maximum tilt angle.

19. The method of claim 18 including:

determining height status information regarding a lifting implement on the vehicle;

determining weight status information regarding a load on the implement;

selecting the maximum tilt angle based on the height status information and the weight status information.

20. The method of claim 18 including:

judging whether a hydraulic valve for controlling tilting of the mast is in a position to cause tilting movement of the mast; and locking the mast against tilting movement when it is judged that the hydraulic valve is not in a position to move the mast.

* * * * *

UNITED STATES PATENT AND TRADEMARK OFFICE

CERTIFICATE OF CORRECTION

PATENT NO. : 6,092,976
DATED : July 25, 2000
INVENTOR(S) : Toshikazu Kamiya

It is certified that error appears in the above-identified patent and that said Letters Patent is hereby corrected as shown below:

Column 5,
Line 30, please change "34a" (first occurrence) to -- 34b --;

Column 5,
Line 32, please change "34a" to -- 34b --;

Column 6,
Line 62, please change "$\theta_2$ ($\theta_2$>$\theta_3$) The" to -- $\theta_2$ ($\theta_2$>$\theta_3$). The --.

Signed and Sealed this

Twelfth Day of March, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,092,976
DATED : July 25, 2000
INVENTOR(S) : Toshikazu Kamiya

It is certified that error appears in the above-identified patent and that said Letters Patent is hereby corrected as shown below:

Title page, Item [54] and Column 1, lines 1-2,
Please delete "DELAYED-ACTION EMPTY-SEAT SAFETY INTERLOCK FOR FORKLIFT CONTROLS" and insert therefor -- TILT CYLINDER CONTROLLING APPARATUS AND METHOD FOR INDUSTRIAL VEHICLE --

Signed and Sealed this

Eighteenth Day of June, 2002

*Attest:*

*Attesting Officer*

JAMES E. ROGAN
*Director of the United States Patent and Trademark Office*